United States Patent [19]

Knudson et al.

[11] 4,337,142

[45] Jun. 29, 1982

[54] CONTINUOUS PROCESS FOR CONVERSION OF COAL

[75] Inventors: Curtis L. Knudson; Warrack G. Willson; Gene G. Baker; Everett A. Sondreal; Sylvia A. Farnum, all of Grand Forks, N. Dak.

[73] Assignee: The United States of America as represented by the United States Department of Energy, Washington, D.C.

[21] Appl. No.: 154,351

[22] Filed: May 29, 1980

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,748,254 | 7/1973 | Gorin | 208/8 LE |
| 3,884,796 | 5/1975 | Hinderliter et al. | 208/8 LE |
| 4,115,075 | 9/1978 | McNomee et al. | 208/8 LE X |
| 4,128,471 | 12/1978 | Malone et al. | 208/8 LE |

OTHER PUBLICATIONS

Slides Used for the CO-Steam GFETC Project Review, Aug. 17-18, 1977, Grand Forks Energy Center.

Application of Liq. Process to Low-Rank Coals, May 30-31, 1979, Lignite Symposium, U. of N.D.

Temp. Effects on Coal Liq. Rates of Depolymerization . . . , 1978, ACS Symposium, Series #71 Organ. Chem. of Coal.

"Chem. Eng. Coal Liq. Program-Quarterly Progress Report, Jan.-Mar. 1979", Bulletin #79-07-EES-03, Jul. 1, 1979, U. of N.D.

Products of Liq. of lignite with Syn. Gas By-Product Slurry Recycle", 1979, ACS, Wash. D.C.

The SRC-II Process, Aug. 3-5, 1976, 3rd Annual International . . . , U. of Pa., (Gulf).

Commerical Scale Development of SRCII Process, Aug. 1-3, 1978, 5th Annual Conference . . . , U. of Pa., (Gulf).

Liquefaction of Coal:, CA 89 149399g, Issue 22, 1978, (Gulf Research & Development Co.).

*Primary Examiner*—Delbert E. Gantz
*Assistant Examiner*—William G. Wright
*Attorney, Agent, or Firm*—Harold M. Dixon; Roger S. Gaither; Richard G. Besha

[57] ABSTRACT

An improved process for converting coal to liquid and gaseous products wherein the liquid products predominate and wherein reactor, tubing, and valve plugging due to carbonate salt formation is reduced by reacting crushed low-rank coal containing about 12 to 30% by weight of water in a solvent at a temperature in the range of about 455° to 500° C., under about 2000 to 5000 psi pressure of a $H_2/CO$ mixture for a liquid residence time of about 20 to 60 minutes. The solvent is a fraction of liquid product defined on a weight basis as being made up of about 55% of which distills at less than 250° C./lmm, about 20% of which is soluble in THF, and about 25% of which is carbon polymer and indigenous inorganic matter. The solvent is further defined as containing at least about 5 weight % of partially hydrogenated aromatics and/or fully hydrogenated aromatics and little or no alkylated aromatics or higher alkanes.

9 Claims, 1 Drawing Figure

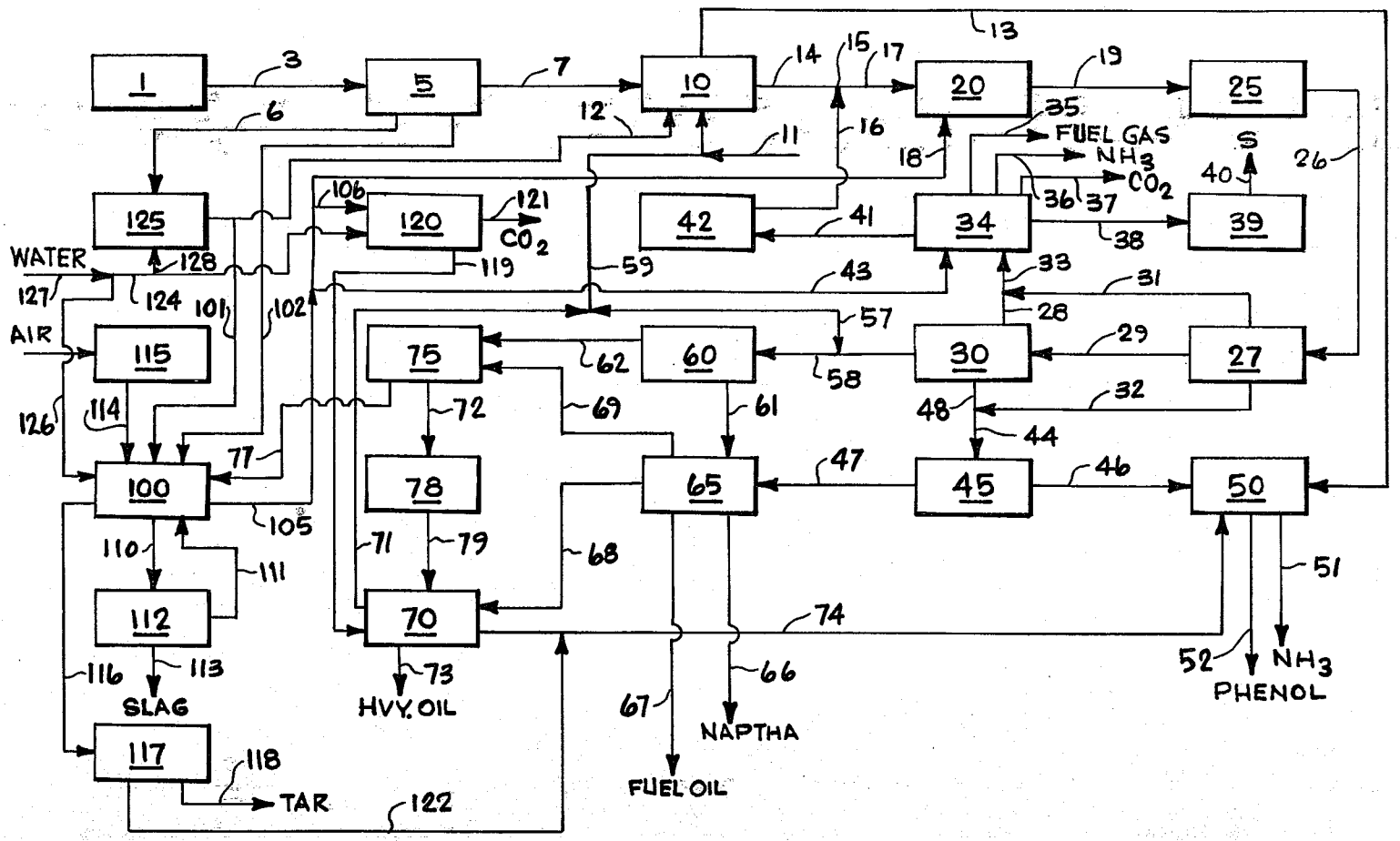
FUEL GAS
NH3
CO2
S
NH3
PHENOL
NAPTHA
FUEL OIL
HVY. OIL
TAR
SLAG
WATER
AIR
CO2

CONTINUOUS PROCESS FOR CONVERSION OF COAL

BACKGROUND OF THE INVENTION

The invention described herein arises out of work performed under contract of employment with the Department of Energy.

FIELD OF THE INVENTION

The present invention broadly relates to the conversion of coal into distillable and gaseous products. More particularly, the present invention relates to the conversion of low rank coal to distillable liquid and gaseous products at relatively high yields of distillable liquid and with minimal reactor solids build-up and plugging of tubing and valves due to carbonate salt formation.

DESCRIPTION OF THE PRIOR ART

Considerable effort has been expended in converting coal to distillable liquids and gases to augment or replace petroleum-derived products because of the rapidly diminishing supply of the latter.

One of the more promising processes for achieving the objective of converting coal to predominantly solids (i.e. at room temperatures, liquids at reaction temperature) is the Solvent Refined Coal Process (SRC-I). The SRC-I process involves the use of a distillate product fraction as a hydrogen-donor solvent. Other features include the use of dry, bituminous coal and the use of hydrogen gas to produce, as the major product, a "depolymerized" solid. Typical yields of the SRC-I process are about 6% light hydrocarbon gases (pipeline gases and LPG), 15% hydrocarbon liquids boiling below 500° F. (260° C.), 19% of a 500°–800° F. (260°–426° C.) fraction, and 60% solids-free $850_+$° F. ($454_+$° C.) residue fraction (Solvent Refined Coal) based on weight of dry coal.

Another promising process is the SRC-II process, which produces, as a major project, a low sulfur liquid rather than a solid as in SRC-I. Other features include those operating parameters recited as applicable to SRC-I. However, there is one significant difference between the SRC-II and SRC-I process. In the SRC-II process a portion of the product slurry is used for solvent rather than a distillate liquid. Typical product and yields are about 11% hydrocarbon gases (i.e. pipeline gas and LPG), 42% of a distillate liquid ($C_5$-850° F. or 454° C.), 24% of solids-free $850_+$° F. ($454_+$° C.) residue, and small amounts of phenol and ammonia.

From the viewpoint of yields of distillable liquid product, the SRC-II process is better and constitutes an improvement over SRC-I. However, from both an economic view-point and a resource conservation viewpoint a still higher yield of distillable liquid product is desirable. Among the difficulties in producing more distillable liquid is to do so by producing less $850_+$° F. residue and without producing more gaseous product at the expense of distillable liquid product. Selective conversion of coal to a distillable liquid as the major product avoids additional steps, some of which are complex, and would require the development of those process steps in lieu of utilizing known technology. For example, the increased conversion to distillable liquid permits the recovery of the fuel oil product by vacuum distillation.

The carbonaceous residue or bottoms therefrom is suitable in quantity and quality to supply process hydrogen requirements by charging the bottoms to a gasifier before or after coking.

Both of the above processes use hydrogen gas and dried bituminous coals. The bituminous coals are easier to liquefy than many other coals. The use of dry coal as feed requires pretreatment to remove all or essentially all of the natural water or moisture present in coal. Drying complicates coal feed preparation. At a moisture content of about 12% or less the low-rank coals are pyrophoric. Hydrogen gas is expensive to produce and processes for making hydrogen gas consume substantial energy if they are not, in fact, energy intensive.

Various publications have reported prior work under numerous sets of conditions which include: temperatures in the range of about 350° C. (662° F.) to 460° C. (860° F.); pressures as high as about 4500 psi; using dry coal in some cases and wet or moist coal (i.e. undried) in other cases with some, but limited, success. Importantly, when attempts are made to conduct liquefaction low rank of coal in continuous versions of SRC-I or SRC-II at prior art conditions, plugging of the equipment frequently occurs. In contrast to the prior art, by a discrete combination of the various features and conditions in accordance with this invention, superior results are obtained in a continuous operation.

It is an object of the present invention to achieve high and increased conversion of low rank coal to liquid product.

Another objective is to achieve the above object with minimal coking or at least without increased coking.

A major object is to achieve the other objects in a continuous process operation whereby disruptions due to plugging or other depositions are greatly reduced if not obviated.

Still another object of the present invention is to achieve a reduction in the amount of solid product or heavy bottoms without a disproportionate increase in gaseous product relative to the distillate liquid product.

It is yet another object of the present invention to achieve the above objects and with simplifications in present solvent refining processes of low rank coal.

Another object of the present invention is to accomplish the other objects using coals which are more difficult to convert and refine.

Other objects, advantages, and novel features will become apparent from the following detailed description.

SUMMARY OF THE INVENTION

The present invention in brief is an improved process of converting coal to liquid and gaseous products wherein the distillable liquid products predominate and wherein reactor, tubing, and valve plugging due to carbonate salt formation is reduced and which process comprises reacting crushed low-rank coal containing about 12 to 30% by weight of water dissolved in a solvent at a temperature in the range of about 440° to about 500° C., under pressure of a $H_2/CO$ gas mixture in the range of about 2000 to 5000 psi, for a liquid residence time in the range of about 20 to 60 minutes, said solvent comprising a fraction of liquid product characterized on a weight basis as having about 55% of product which distills at less than 250° C. at 1 mm of pressure, about 20% of which is soluble in THF, and about 25% of which is a mixture of carbon polymer and indigenous inorganic matter. Said solvent can be further characterized as containing at least about 5 weight % of partially hydrogenated aromatics and/or fully hydrogenated aromatics and little or no alkylated aromatics or higher alkanes.

BRIEF DESCRIPTION OF THE DRAWINGS

The FIGURE is a schematic flow diagram illustrating the liquefaction of coal according to principal feature(s) of this invention, which excludes in many instances standard, conventional, or otherwise known features in the art such as valves, pumps, gauges, etc.

DESCRIPTION OF THE PREFERRED EMBODIMENTS

Although any of the various types of coal can be employed in the present process, the low-rank coals, which are more difficult to liquefy and lignites in particular, are generally preferred. Examples of these low-rank coals are: Australian brown coal, Minnesota peat, North Dakota lignites from the Beulah and Gascoyne mines, and subbituminous from the Wyodak mine in Montana.

The coal is to be employed in a crushed or pulverized form. In crushed form the particle size is desirably less than about ⅛ inch. Coal having a particle size of about 100% minus-60 mesh or less is preferred. Most preferred is coal having a particle size in the range of about 90% minus-200 mesh to 100% minus-60 mesh. While coal particle size is important to obtain good contact and rapid reaction, the moisture content is also very important. The coal should contain ambient, natural, or indigenous water and therefore should not be dried to contain less than about 12% water by weight. Not only does the use of wet or moist coal avoid the drying operation but surprisingly results in the attainment of substantial process advantages. A small but effective amount of water in combination with the other reaction features of the present invention enables continuous operation without reactor, tubing, and valve plugging of the equipment through the formation of solids (e.g. salts) in the reactor or downstream. Although we do not intend to be bound thereby, our explanation of this is based on the theory that a small amount of water enables the inorganic matter in the coal to form the more soluble bicarbonates instead of carbonates in the liquefaction step. Ammonium carbonates have been found to cause plugging of valves (e.g. letdown valves) in dry systems. Therefore, it is believed that the less soluble carbonates are responsible for the salts and other solid deposits found under conditions employed by others. We have also found elemental sulfur deposits in equipment at reaction conditions employed here when a dry system and $H_2$ is used. The amount of water which is to be used can be in the range of about 12 to 30% by weight of the coal feed, but preferably is in the range of about 12 to 16% on the same basis. The coal can be dried to contain the desired amount of water. Where water naturally present is not sufficient, then it can be added to the process, usually with the coal feed. However, it should be appreciated that water naturally present in coal is intimately mixed with the inorganics present principally in hydrate form. Such form produces better results in avoiding formation of undesirable solids in the process.

The temperatures and pressures in the present invention have been used before; however, certain restricted portions of those ranges used in combination with the other features of this invention produce substantially improved results. At temperatures above about 455° C. (824° F.) and particularly above about 460° C. (860° F.) the liquefaction occurs at a greatly accelerated rate if not at an exponential rate. However, adverse reactions (such as gasification, coking, polymerization, etc.) also occur at a greatly accelerated rate at higher temperatures, and therefore temperatures above about 500° C. (932° F.) are not to be employed. The pressures of hydrogen-rich gas suitable in the invention are those above about 2000 psi, but generally a pressure above about 5000 psi is not employed. As a general rule the temperature and pressure are varied directly with respect to each other. That is, the higher temperatures call for the use of higher pressures in order to keep more solvent in the liquid phase in the reactor. Preferred temperatures and pressures are about 455° C. (842° F.) to 480° C. (896° F.) and about 2000 to 4000 psi. Most preferred temperatures and pressures are in the range of about 455° C. to 480° C. and 2500 to 3500 psi in a great number of cases.

While temperatures and pressures vary directly, the residence or reaction time is to be varied inversely with those conditions and especially so with the temperature. Liquid residence times in the reactor of about 20 to 60 minutes will be found suitable. Preferably the liquid residence times in the reactor are in the range of about 30 to 60 minutes. Alternately stated, the reaction or residence time in the process is conveniently expressed as flow rates. It is also important to remember that there are both liquid and gases involved in the reaction, and therefore there are two flow rates to be monitored and controlled. The liquid hourly space velocity (LHSV) should be in the range of about 0.4 to 3.2/hr, preferably in the range of about 0.7 to 1.6/hr. At the same time, the gas hourly space velocity (GHSV) should be in the range of about 218 to 893/hr, preferably in the range of about 500 to 700/hr, and most preferably about 625/hr.

The hydrogen-rich gas useful in the process can be pure hydrogen or a mixture of gases containing hydrogen and carbon monoxide. However, in this invention we have found that mixtures containing hydrogen and carbon monoxide are not only cheaper than hydrogen alone, but the reaction kinetics are enhanced. Furthermore, the mixture of $H_2$ and CO produces better results than when either CO or $H_2$ alone is used. Although other ratios can be employed, we prefer a mixture of hydrogen and carbon monoxide in approximately equimolar amounts as the pressure medium and gaseous reactant.

A solvent is necessarily employed in order to conduct the process in a fluid form, that is generally in liquid (at reaction conditions at least) and gaseous phases. Importantly, however, the solvent is also a hydrogen donor to effectuate depolymerization and other reactions (e.g. hydrocracking) through the stabilization of free-radicals which convert the coal to a liquid having properties more akin to conventional petroleum crude oils. Those skilled in the art know that one highly effective donor solvent is tetralin. While that illustrative hydroaromatic compound performs very well in the present process, it is desirable to use a more non-volatile donor, and it is a matter of practical necessity that a solvent be used which is less expensive, which requires less hydrogen demand in the preparation, and which is more readily available. One such solvent is a product fraction which can be readily recycled to the reactor. This recycle stream is characterized as being about 55% by weight of product which distills at less than 250° C. (482° F.) at 1 mm (Hg) of pressure, about 20% of which is soluble in tetrahydrofuran (THF), and about 25% of which is a mixture of carbon polymer and indigenous inorganic matter.

The recycle product fraction used as solvent not only serves as a fluid carrier and hydrogen donor for the coal but enables the heavier fraction of the dissolved coal to be returned to the reaction zone. Further, the recycle causes the concentration of the indigenous inorganic matter from the coal to be increased. The inorganic matter, which comprises alkali and alkaline earth metal compounds, has a catalytic effect and enhances the liquefaction of coal. The solvent can contain small amounts of, but preferably is essentially free of, both higher alkanes (i.e. 12 carbons and above, e.g., hexadecane) and alkylated aromatics (e.g., the methylnaphthalenes). The solvent should contain at least about 5% and, preferably, at least about 10% by weight of hydroaromatics. Hydroaromatics are intended to include partially hydrogenated aromatics, such as tetralin, and/or fully hydrogenated aromatics, such as decahydrophenanthrene. Said solvent can be further characterized as comprised of about 55% thereof with a boiling point less than 250° C. at 1 mm pressure, about 20% thereof which is soluble in THF, and about 25% thereof which is a mixture of carbon polymer and indigenous inorganic matter.

The coal loading of the solvent can be as high as about 40% by weight. We prefer about 30 to 40% by weight of coal in the solvent.

In order to disclose more clearly the nature of the present invention and the advantages thereof, reference will hereinafter be made to certain specific embodiments which illustrate the herein-described process. It should be clearly understood, however, that this is done soley by way of example and is not to be construed as a limitation upon the spirit and scope of the appended claims.

DETAILED DESCRIPTION OF DRAWING

Run of the mine coal 1 from working inventory is fed by conveyor 3 to crusher 5 where it is crushed and sized to less than ⅛ inch for the liquefaction reactor 25 and ¾ to 2 inch for the gasifier 100. The coal is fed through line 7 and next mixed with recycle slurry and hydrotreated heavy oil in a combination slurry mix tank/dryer 10 to provide a slurry comprising on a weight basis about 30% coal (as received), about 60% recycle slurry, and about 10% hydrotreated heavy oil. Sufficient residence time is provided to remove approximately 50 to 75% of the original coal moisture of about 30% utilizing both the sensible heat of the recycle slurry fed to the mix tank by line 11 and supplemental plant steam fed by line 12 to achieve a moisture content of about 12 to 16% by weight. Slurry drying of the coal has two advantages: (1) oxidization and subsequent deactivation of the coal during drying is kept to a minimum; and (2) the need for additional coal drying equipment is eliminated.

Waste water and some light organics leaving the slurry drier through line 13 as vapor are condensed and fed to a water treatment plant 50.

The partially dried feed slurry is continuously circulated past the suction of the slurry charge pumps (not shown) and back into the slurry drying tank (recirculation line not shown). The high-pressure pumps deliver the slurry at the operating pressure of the reactor (about 3000 psig) through line 14 to a gas-slurry mixing tee 15 where it is admixed with reducing gas ($H_2$+CO) fed thereto by line 16. The three-phase mixture is passed through line 17, then preheated in heater 20 to 400° to 425° C. and introduced into the coal liquefaction reactor 25 by line 19. Coal residence time in the reactor is between 40 and 60 minutes (i.e., LHSV of about 1.6/hr and GHSV of about 625/hr) with both gaseous and liquid products leaving at the top through line 26. The heater outlet temperature is controlled to allow for about a 50° C. increase due to exothermic reaction in the reactor 25 to give the final reaction temperature of about 460° to 470° C.

Following the reactor 25 is a number of product recovery stages. First, a degassing separation is made in high-pressure product separator 27 at the same operating pressure as the reactors but at the lower temperature of about 300° C. Water and naptha from separator 27 are withdrawn through line 32 as vapor and are cooled, condensed, and depressured. Then stream 32 is combined with a similar stream 48 from stripper 30 to form stream 44 which is fed to the gravimetric oil-water separators 45.

The product slurry bottoms in line 29 from the degassing separator 27 are depressured into product stripper 30 which is operated at 260° C. and about 125 psig. Depressuring releases additional gas which was dissolved at the higher pressure along with residual water and light oil. These gases are withdrawn from the stripper, cooled, and separated. These gases are then withdrawn through line 28 and combined with the gases in 31 to form stream 33. The noncondensible product gases are depressured and fed through line 33 to the gas recovery and cleanup unit 34 or are used as plant fuel. Gas stream 33, along with makeup gas from the gasifier in line 43, are first purified to remove carbon dioxide stream 37, hydrogen sulfide stream 38, and ammonia stream 36, and second, cryogenically cooled to separate the $C_1$–$C_4$ hydrocarbon gases into a stream 35 and thereby leaving a mixture of hydrogen and carbon monoxide. The $H_2$ and CO are then recompressed in compressors 42 and returned to the gas-slurry mixing tee 15 through line 16.

The hydrogen sulfide stream in line 38 is burned with sulfur dioxide obtained from within the sulfur recovery unit to yield elemental sulfur as product 40 which can be sold as a by-product along with liquefied ammonia. The $C_1$–$C_4$ hydrocarbon gases in line 35 are separated using a depropanizer (not shown) and debutanizer (not shown) to yield pipeline quality gas. Further separation to recover ethane as a feed stock for ethylene production could be added if desired. The additional water-oil mixture from the stripper is fed to the oil-water separators 45. The recovered gases in line 33 are either piped to the gas recovery and cleanup unit 34 or are used as plant fuel. The bottoms stream from the product stripper is split into a recycle slurry stream which is returned by lines 57, 59, and 11 to the slurry mixer/dryer 10 and a product slurry stream which is first preheated to about 340° C. and then fed by line 58 to a vacuum flash distillation tower 60 operating at approximately 15 to 25 torr. The vacuum distillate is taken overhead, condensed, collected, and withdrawn from the vacuum system through line 61. It is then combined with the oils in line 47, recovered by the oil-water separators 46, preheated, and fed into a series of distillation towers 65 and fractionated to naptha 66, fuel oil 67, and heavy oil, and heavy oil cuts 68. The fuel oil and naptha fractions are sold as liquid products, while the heavy oils are catalytically hydrotreated in hydrogenator 70 and returned to the slurry preparation equipment 10 by lines 71, 59, and 11.

The vacuum bottoms 62 from the vacuum flash distillation 60 are mixed with carrier steam 69 rich in naptha, pressurized, heated, and fed to a gravity-settler, solvent extractor 75. Here the lower molecular weight non-distillables 72 are extracted using light oil stream 69 from distillation towers 65 and are recovered from the overflow by flash distillation 78. The deashed, nondistillable coal liquid 79 is combined with heavy oils 68 from distillation 65 and is then pressurized, heated, and reacted with hydrogen in a trickle bed catalytic reactor 70. The hydrogenated product is returned by line 71 to the slurry mix tank/dryer 10 where it is mixed with the recycle slurry stream 59 and fresh coal 17. Hydrogenated heavy oil from hydrogenator 70 is recovered as product stream 73. Water separated by the hydrogenation product is charged by line 74 to waste water treatment 50.

The bottoms 77 from the solvent extraction unit are gasified in a slagging, fixed-bed gasifier 100.

The gasifier is fed both by the solvent extractor 75 through line 77 and from the coal crusher 5 through line 102 and reacts the organic portions with steam fed by a boiler 125 through line 101 and oxygen stream 114 from a cryogenic air separator unit 115 to produce syngas ($H_2+CO$). The syngas is fed by lines 105 and 106 to the slurry/gas preheater 20 for heat production by lines 105 and 43 to the gas recovery and cleanup 34 and by lines 105 and 106 to a shift converter, cleanup and compression unit 120, to produce hydrogen through line 119 for the catalytic hydrotreater 70.

Waste slurry from the gasifier 100 is passed through line 110 to filter 112, and the recovered water is recycled to the quench zone of the gasifier 100 by line 111. The filter residue or slag by-product stream 113 is disposed of. Tar and water are removed from gasifier 100 and passed by line 116 to a tar-water separation unit 117. A tar stream 118 is recovered or either reinjected into the gasifier 100 or piped to distillation 65. A water stream 122 is separated which can be treated by charging same to waste water treatment unit 50 for example through line 74 with water from hydrogenator 70. Additional ammonia and phenol products are recovered in lines 51 and 52, respectively, from water treatment unit 50.

Water requirements of units such as the shift reactor 120 are supplied by a water stream 124 and the gasifier by a water stream 126, which streams are supplied by a water source 127.

Power requirements are supplied by steam boiler and power plant 125 which is supplied coal by line 6 and water by lines 124 and 128.

While particular embodiments of the invention have been described, it will be understood, of course, that the invention is not limited thereto, since many modifications may be made; and it is therefore contemplated to cover by the appended claims any such modifications as fall within the true spirit and scope of the invention.

What is claimed is:

1. A continuous process of converting low rank coal to liquid and gaseous products wherein plugging due to carbonate salt formation is reduced, which process comprises reacting crushed low-rank coal containing about 12 to 30% by weight of water dissolved in a solvent at a temperature in the range of about 455° to 500° C., under pressure of a $H_2/CO$ gas mixture in the range of about 2000 to 5000 psi, for a liquid residence time in the range of about 20 to 60 minutes, said solvent comprising a fraction of liquid product characterized as having about 55% by weight of product which distils at less than 250° C. at 1 mm of pressure, about 20% of which is soluble in THF, and about 25% of which is a mixture of carbon polymer and indigenous inorganic matter; said solvent being further characterized as containing at least about 5 weight % of partially hydrogenated aromatics and little or no alkylated aromatics or higher alkanes.

2. A process according to claim 1 wherein the reaction time is in the range of about 30 to 60 minutes.

3. A process according to claim 1 wherein the particle size of said crushed coal is less than about ⅛ inch.

4. A process according to claim 1 wherein the pressure is in the range of about 2000 to 4000 psi.

5. A process according to claim 1 wherein the coal loading of said solvent is in the range of about 30% to 40%.

6. A process according to claim 1 wherein the particle size of said crushed coal is about 100% minus-60 mesh or less.

7. A process according to claim 1, 4 or 5 wherein the temperature is in the range of about 455° to 480° C.

8. A process according to claim 1 wherein the water content of the coal is in the range of about 12 to 16%.

9. A process according to claim 1 wherein the coal is lignite, the temperature is in the range of about 460° to 480° C., the pressure is in the range of about 2500 to 3500 psi, the particle size of the coal is in the range of about 90% minus-200 mesh to 100% minus-60 mesh and said coal contains about 12% to 16% by weight of water, the coal loading of the solvent is in the range of about 30 to 40%, and the solvent contains at least about 10% of said partially or fully hydrogenated aromatics.

* * * * *